United States Patent [19]

Pearson

[11] 4,454,636

[45] Jun. 19, 1984

[54] SPRING FASTENER CLIP FOR WOODEN FURNITURE RAILS

[75] Inventor: Kenneth C. Pearson, Glenview, Ill.

[73] Assignee: Hartco Company, Skokie, Ill.

[21] Appl. No.: 378,875

[22] Filed: May 17, 1982

[51] Int. Cl.[3] ..... A47C 23/00

[52] U.S. Cl. ..... 24/347; 5/259 R; 5/259 B

[58] Field of Search ..... 5/259 R, 259 B; 24/346, 24/347, 115 A, 115 G, 121, 129 B, 256, 259, 265 C; 248/226.5, 227; 267/110, 111, 112; 403/188, 283

[56] References Cited

U.S. PATENT DOCUMENTS

| | | | |
|---|---|---|---|
| 1,692,218 | 11/1928 | McIntosh | 24/115 A |
| 3,276,801 | 10/1966 | Jones | 5/259 R |
| 3,773,310 | 11/1973 | Crosby | 5/259 B |
| 3,969,793 | 7/1976 | Crosby | 5/259 B |
| 4,062,087 | 12/1977 | Lingle | 5/259 R |
| 4,102,586 | 7/1978 | Pearson et al. | 5/259 R |

FOREIGN PATENT DOCUMENTS

| | | | |
|---|---|---|---|
| 2252506 | 12/1973 | Fed. Rep. of Germany | 267/110 |

*Primary Examiner*—Robert Peshock
*Assistant Examiner*—John G. Weiss
*Attorney, Agent, or Firm*—Wallenstein, Wagner, Hattis, Strampel & Aubel

[57] ABSTRACT

An improved fastener clip for holding the end bar of a sinuous cushion-supporting spring in position on the wooden rail of an article of furniture. The clip, in its preferred form, has a base portion, a leg portion and a reentrant or reverse curved portion. The base portion and the reentrant or reverse curved portion are provided with end bar retaining means which cooperate to lock the end bar on the clip when the reentrant or reverse curved portion is wrapped on the end bar. The reentrant or reverse curved portion also has an impact receiving, upwardly extending lip adapted to receive and transmit the full force of a hammer blow, for example, whereby the reentrant or reverse curved portion is positively and effectively wrapped on the end bar while at the same time positioning the end bar retaining means in end bar locking relation to each other.

1 Claim, 5 Drawing Figures

Fig 1
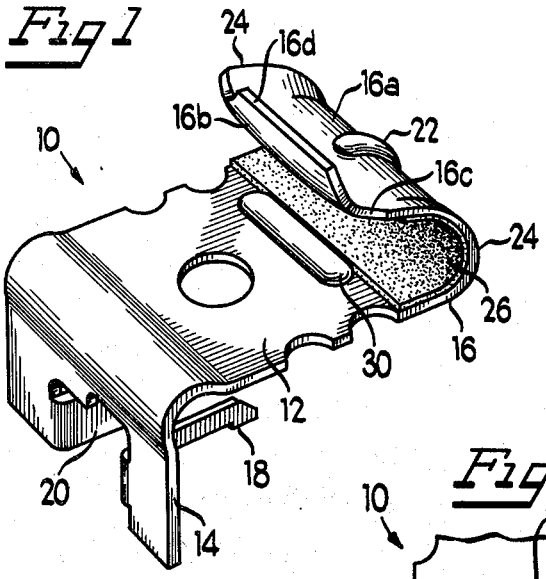
Fig 3
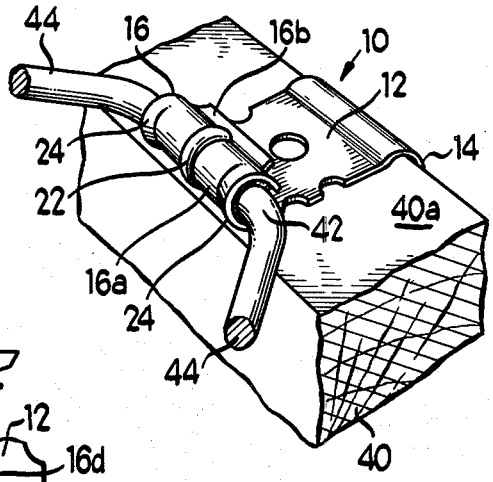
Fig 2
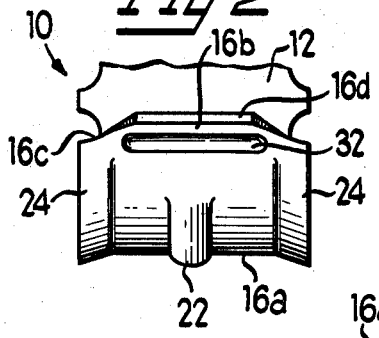
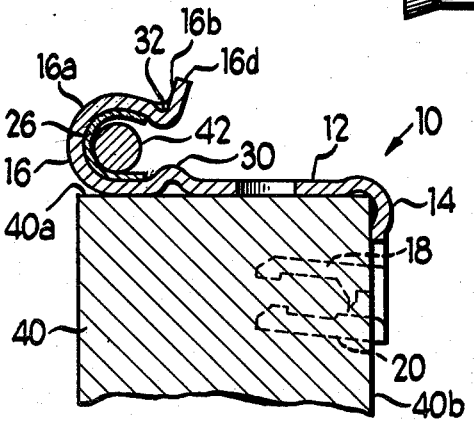
Fig 4
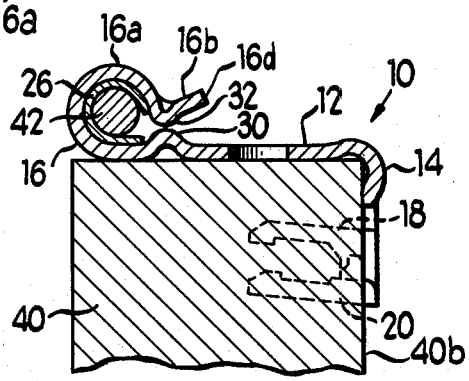
Fig 5

SPRING FASTENER CLIP FOR WOODEN FURNITURE RAILS

TECHNICAL FIELD

The present invention relates to an improved spring fastener clip of the type which is applied to the wooden rails of furniture frames for anchoring the end bars of cushion supporting springs in position on the wooden rails.

BACKGROUND OF THE PRIOR ART

U.S. Pat. No. 4,102,586 discloses spring fastener clips which represent a marked improvement over fastener clips then known in the art. The clips of the patent eliminate the need for nails, staples or other auxiliary attachment means for maintaining the clips in a fixed position on the wooden rails of the framework of an article of furniture, and, in addition, overcome the problem of wood splitting which characterized the prior art clips. The clips of the patent also are more economical to make in that they require less metal to provide a self-sustaining integrated structure. The clips disclosed in U.S. Pat. No. 4,102,586, in brief, comprise a base portion which seats or rests on the top surface of a wooden rail of an article of furniture, and a flange or leg which lies flush with the outside face of the rail. The flange or leg is provided with integral rail-penetrating anchor prongs which, when the clips are applied, enter the wood transversely of the general plane of the wood grain, preferably at a right angle so as to reduce the possibility of any splitting of the wooden rail. The clips also include a reentrant or reverse curved portion which overlies the base portion by a distance approximately equal to the diameter of the rod stock from which the sinuous upholstery spring to be secured on the rail is fabricated. The reentrant or reverse curved portion provides a hook-like arrangement which receives the end bar of an upholstery spring and is adapted to be bent, crimped or wrapped on the end bar.

BRIEF SUMMARY OF THE INVENTION

The fastener clip of the present invention represents an improvement over the fastener clips disclosed in the aforementioned U.S. patent. The clip of this invention not only incorporates all of the features and advantages of the clips of the patent, but, also, provides means both for more positively crimping or wrapping the reentrant or reverse curved portion of the clip on the end bar of an upholstery spring, and for more securely retaining the end bar on the clip after the crimping or wrapping operation has been performed. These results are achieved, moreover, without any increase in the cost of manufacturing the clip either by way of added equipment or materials.

The improved fastener clip of this invention, in brief, comprises a one-piece unit having a base portion adapted to overlie the top or upper surface of a wooden rail of the framework of an article of furniture. A rail-engaging leg portion is integrally joined to one end of the base portion, and is adapted to overlie the outside face of the wooden rail. The leg portion is provided with integral, rail-penetrating anchoring means such as tangs or prongs for securing the fastener clip on the rail. Integrally joined to the other end of the base portion is a reentrant or reverse curved portion which overlies the base portion by a distance slightly greater than the diameter of the rod stock of which the upholstery spring is made. The reentrant or reverse curved portion provides a hook-like arrangement which receives the end bar of an upholstery spring and is adapted to be bent, crimped or wrapped on the end bar. The leading or free margin of the reentrant or reverse curved portion of the clip of the present invention is formed so that it extends upwardly at an appreciable angle with relation to the periphery of the arcuate or hook-like area of the reentrant or reverse curved portion of the clip thereby providing an impact-receiving surface. The position of the impact-receiving surface in relation to the arcuate area of the reentrant or reverse curved portion of the clip enables the full force of an impact tool, whether it be a hammer, or the blade or plunger of a power driven tool, to be consistently and unerringly applied to it. As a result, the reentrant or reverse curved portion of the clip is bent, crimped or wrapped on the end bar of an upholstery spring in a manner to positively, and most effectively, secure the end bar on the clip. In order to enhance and augment the end bar holding capabilities of the clip, the base portion and the reentrant or reverse curve portions of the clip advantageously are each provided with spring end retaining means which, when the reentrant or reverse curved portion is bent, crimped or wrapped on the end bar of an upholstery spring, will cooperatively act to lock the end bar in position on the clip. In a preferred embodiment of the invention, the spring end retaining means comprises an elongated, transverse stop or detent formed in the base portion of the clip adjacent to the juncture of the base portion with the reentrant or reverse curved portion, and a similar stop or detent formed in the reentrant or reverse curved portion at the juncture of the arcuate area thereof with the outwardly extending impact-receiving leading or free margin of that portion of the clip. When the reentrant or reverse curved portion of the clip is bent, crimped or wrapped on the end bar of an upholstery spring, the stops or detents will be positioned in substantially overlying, nearly abutting or abutting relation to one another thereby acting to resist any forces which may tend to dislodge the end bar of the spring from the clip.

The foregoing, and other features and advantages of the improved fastener clip of this invention will become more apparent from the description to follow, taken in conjunction with the accompanying drawings wherein:

BRIEF DESCRIPTION OF THE DRAWINGS

FIG. 1 is a perspective view of an embodiment of the fastener clip of the present invention;

FIG. 2 is a fragmentary top plan view of said embodiment of the fastener clip;

FIG. 3 is a fragmentary perspective view of a wooden rail of a furniture frame showing said embodiment of the clip applied thereon and an end bar of a sinuous cushion-supporting spring secured on the clip;

FIG. 4 is a side elevational view in section showing an end bar of an upholstery spring supported on the reentrant or reverse curved portion of the clip before said portion has been bent, crimped or wrapped on the end bar; and FIG. 5 is a sectional view corresponding to the view of FIG. 4 showing the end bar secured on the clip after the reentrant or reverse curved portion has been bent, crimped or wrapped on the end bar.

DETAILED DESCRIPTION OF THE INVENTION

Referring, now, in greater detail to FIGS. 1 and 2 of the drawings, the embodiment of the fastener clip there illustrated, and designated generally by reference numeral 10, advantageously is formed from a strip of sheet metal stock, preferably steel, by a punch press operation, or the like. The clip 10 has a base portion 12 to one end of which is integrally joined a flange or leg portion 14, and to the other end of which is integrally joined a reentrant or reverse curved portion 16. The flange or leg portion 14 forms an approximate right angle along its line of juncture with the base portion 12, and is provided with a pair of spaced wood-penetrating anchor tangs or prongs 18 and 20 which are struck from the flange or leg 14. The shape and position of the prongs 18 and 20 and the manner in which they are struck from the flange or leg portion 14 are fully described in U.S. Pat. No. 4,102,586. It should be understood, therefore, that the teachings of that patent in so far as they find a correspondence or common ground with the teachings of the present invention are incorporated herein by reference.

The reentrant or reverse curved portion 16 of the clip 10 partly overlies the base portion 14 by a distance which desirably is slightly greater than the diameter of the rod stock from which the upholstery spring is made. As illustrated, the portion 16 of the clip 10 comprises an arcuate, end bar receiving and supporting section **16*a*, and an upwardly extending impact-receiving margin or lip 16*b*. The lip 16*b* forms an angle approaching a right angle with the transverse margin 16*c* of the arcuate segment 16*a* along its line of juncture therewith. The outward extend of the leading of free edge of the lip 16*b* provides a contact surface 16*d* adapted to receive and transmit the full force applied to the lip 16*b*** by a tool such as a hammer, or the plunger or blade of a power driven tool.

The portion 16 also desirably has a centrally located, offset or reinforcing rib 22 formed on the arcuate section **16*a* thereof, and the side edges or margins 24—24 of the section 16*a* are flared outwardly to prevent damage to a cushioning liner 26 attached to the inner wall of the section 16*a*, and to prevent the edges from cutting into the end bar of an upholstery spring supported on the portion 16**.

Spring end bar retaining means in the form of an elongated, outwardly extending, transverse stop or detent 30 on the base portion 12, and an elongated inwardly extending, transverse stop or detent 32 on the portion 16 advantageously is provided for the clip 10 to more securely lock or retain the end bar of an upholstery spring on the clip.

Referring, now, in particular to FIGS. 3, 4 and 5 of the drawings, the clip 10 is shown applied on a wooden rail 40 of a cushion-supporting wooden frame associated with the seat or backrest of an article of furniture such as a sofa, chair, or the like. If it is assumed that the rail 40 is the front rail of such an article of furniture, it will be understood that the rail 40 opposes a parallel back rail and that it is the function of the clip 10 to support an end bar 42 of one of a series of bowed sinuous spring strips or members 44 which extend between the rails. The clips 10 are arranged in opposed pairs on the front and back rails, each pair serving to support therebetween one of the spring members 44.

As best shown in FIGS. 4 and 5, the clip 10 is secured on the rail 40 by means of the tangs or prongs 18 and 20 carried on the flange or leg portion 14 of the clip. The prongs, as disclosed in U.S. Pat. No. 4,102,586, are driven into the rail in a manner such that the planes or sides thereof lie at substantially a right angle to the grain of the wood thereby avoiding splitting of the rail. The base portion 12 of the clip 10 rests in flush engagement on the upper face **40*a* of the rail 40, while the flange or leg portion 14 is positioned in flush engagement against the outer vertical face 40*b* of the rail 40. The reentrant or reverse curve portion 16 of the clip is shown in its open position in FIG. 4, with the end bar 42 supported in the arcuate section 16*a* thereof. In FIG. 5 the reentrant or reverse curved portion 16 is shown bent, crimped or wrapped on the end bar 42. Bending, crimping or wrapping of the portion 16 on the end bar 42, as indicated, is achieved by striking the impact surface 16*d* of the upwardly extending lip 16*b* of the section 16 with a suitable tool. The full force of the blow, whether it is delivered by a hand held hammer or power driven tool, is transmitted to the lip 16*b* which moves downwardly causing the arcuate section 16*a* to enfold, encase or enwrap the end bar 42. The downward movement of the lip 16*b*, under the force of the blow applied to it, acts to position the detents 30 and 32 in substantially superposed, nearly abutting, or abutting relation to each other thereby firmly retaining or locking the end bar 42 on the clip. The detents 30 and 32 serve, in the main, to resist any forces applied to the spring strip which may tend to move the end bar 42 in the direction of the flange or leg portion 14 of the clip and which may otherwise dislodge the end bar 42 from the arcuate section 16*a* of the portion 16. FIG. 3 illustrates in perspective the clip 10 in its final, spring strip retaining condition on the rail 40**.

While the invention has been illustrated and described in relation to a preferred embodiment thereof, it is to be understood that others skilled in the art will perceive variations of that embodiment in the light of the disclosure hereinabove peresented. Therefore, only in so far as the invention has been particularly set forth in the accompanying claims is the same to be limited.

I claim:

1. A fastener clip for securing an end of an upholstery spring to a wooden rail of the framework of an article of furniture, comprising: a base portion adapted to overlie and be completely supported on the upper surface of a wooden rail of the framework of an article of furniture, a rail-engaging leg portion integrally joined to one end only of the base portion, said leg portion having integral anchoring means adapted to be embedded in the wooden rail for securing the fastener clip on the wooden rail, a reentrant portion integrally joined to the other end of the base portion for receiving an end of an upholstery spring and being adapted to be wrapped thereover, said reentrant portion being supported on the upper surface of said wooden rail and the base portion by a distance slightly greater than the diameter of the end of an upholstery spring to be received in the reentrant portion, said reverse curved section having and integral transverse lip which extends upwardly and outwardly at an angle approaching a right angle along its line of juncture with said reverse curved portion said transverse lip providing an impact receiving surface for enabling the reverse curved section of the reentrant portion to be wrapped on an end of an upholstery spring by a hand-held or automatic impacting tool, and cooperating upholstery spring end retaining means provided on the base portion and the reversed curved section of the reentrant portion of the clip, said spring end retaining means including elongated transverse inwardly extending detents positioned in spaced, substantially opposed relation to one another, and adapted, when the reverse curved section of the reentrant portion is wrapped over an end of an upholstery spring, to be positioned in substantially abutting or near abutting relation thereby acting to both lock the end of an upholstery spring on the clip and to resist any forces which may tend to dislodge the end of an upholstery spring from the reentrant portion of the clip.

* * * * *